US008442410B2

(12) United States Patent
Burry et al.

(10) Patent No.: US 8,442,410 B2
(45) Date of Patent: May 14, 2013

(54) APPARATUS AND METHOD FOR CLEANING A PHOTORECEPTOR IN A PRINTING APPARATUS

(75) Inventors: Aaron Michael Burry, Ontario, NY (US); Bruce Earl Thayer, Spencerport, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 401 days.

(21) Appl. No.: 12/783,992

(22) Filed: May 20, 2010

(65) Prior Publication Data

US 2011/0286752 A1 Nov. 24, 2011

(51) Int. Cl.
*G03G 15/00* (2006.01)

(52) U.S. Cl.
USPC ..... 399/71; 399/354

(58) Field of Classification Search ..... 399/71, 399/353, 354
See application file for complete search history.

(56) References Cited

U.S. PATENT DOCUMENTS

| | | | | |
|---|---|---|---|---|
| 5,438,397 | A * | 8/1995 | Okano et al. | 399/150 |
| 6,611,665 | B2 | 8/2003 | DiRubio et al. | |
| 2008/0008483 | A1 * | 1/2008 | Hamaya et al. | 399/44 |
| 2008/0152371 | A1 | 6/2008 | Burry et al. | |
| 2008/0170869 | A1 | 7/2008 | Ramesh et al. | |
| 2010/0086321 | A1 | 4/2010 | Burry et al. | |

* cited by examiner

*Primary Examiner* — Hoang Ngo
(74) *Attorney, Agent, or Firm* — Ronald E. Prass, Jr.; Prass LLP

(57) ABSTRACT

An apparatus and method that cleans a photoreceptor in a printing apparatus is disclosed. The method can include setting a voltage bias of an electrostatic cleaning brush in a printing apparatus to a first voltage bias. The method can include generating an image on media using a photoreceptor. The method can include cleaning the photoreceptor using the electrostatic cleaning brush operating at the first voltage bias. The method can include measuring operating conditions of the printing apparatus to determine an expected film accumulation rate on the photoreceptor. The method can include adjusting the voltage bias on the electrostatic cleaning brush to a second voltage bias based on the measured operating conditions.

20 Claims, 6 Drawing Sheets

APPARATUS AND METHOD FOR CLEANING A PHOTORECEPTOR IN A PRINTING APPARATUS

BACKGROUND

Disclosed herein is an apparatus and method that cleans a photoreceptor in a printing apparatus.

Presently, printing devices, such as printers, multifunction media devices, xerographic machines, and other devices produce images on media sheets, such as paper, substrates, transparencies, plastic, cardboard, or other media sheets. To produce an image, marking material, such as toner or other marking material, is applied to a photoreceptor. The marking material is then transferred from the photoreceptor to the media sheet to create an image on the media sheet.

Electrostatic cleaning brushes are designed to remove small amounts of toner remaining on the photoreceptor after incomplete transfer to the media sheet and much larger amounts of toner on the photoreceptor when transfer has been disabled. Typical normal operation transfers 90% or more of the image toner on the photoreceptor to the media sheet. The residual 10% or less of the developed image toner can be cleaned by the electrostatic brush at a relatively low voltage bias. When transfer has been disabled, 100% of the developed image toner must be cleaned. Cleaning this much larger amount of toner requires a higher voltage bias and sometimes more than one cleaning pass through the cleaner. Transfer is typically disabled in normal operation for process control patches developed in the inter-document zones on the photoreceptor, in performance of a process control adjustment or diagnostic routine, or in recovery from a paper jam where the print media has failed to arrive at transfer.

Unfortunately, excessive filming of the photoreceptor surface occurs under certain operating conditions. Electrostatic cleaning brushes can be used to reduce photoreceptor filming by wearing the photoreceptor surface. To prevent unwanted film generation, and the associated image quality defects, the wear rate of the photoreceptor from the cleaning brushes must be maintained sufficiently high at design time to prevent excessive film buildup. However, a variety of noise factors affect the rate of film generation, so it is somewhat difficult to predict the required film removal rate across all potential conditions. As a result, a tradeoff must currently be made that results in excessive photoreceptor wear across many situations. In fact, there has been concern about having too low of a photoreceptor wear rate in some printing devices. Design time optimization across the entire gamut of potential operating conditions leads to higher photoreceptor wear rates than required for many printing devices, resulting in higher run costs.

For example, an electrostatic brush cleaner system can use a combination of mechanical disturbance and applied bias, such as an electric field, to effect toner removal from a photoreceptor surface. In most print engines, the bias applied to the brushes is determined at design time. The bias chosen is typically the value required to clean the largest stress input of toner in one or two passes through the cleaner. Unfortunately, the use of a fixed bias results in unnecessary wear on the photoreceptor in all but the highest stress conditions.

Thus, there is a need for an apparatus and method that cleans a photoreceptor in a printing apparatus by adjusting a cleaning brush bias.

SUMMARY

An apparatus and method that cleans a photoreceptor in a printing apparatus by adjusting a cleaning brush bias is disclosed. The method can include setting a voltage bias of an electrostatic cleaning brush in a printing apparatus to a first voltage bias. The method can include generating an image on media using a photoreceptor. The method can include cleaning the photoreceptor using the electrostatic cleaning brush operating at the first voltage bias. The method can include measuring operating conditions of the printing apparatus to determine an expected film accumulation rate on the photoreceptor. The method can include adjusting the voltage bias on the electrostatic cleaning brush to a second voltage bias based on the measured operating conditions.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

The embodiments include a method of cleaning a photoreceptor in a printing apparatus. The method can include setting a voltage bias of an electrostatic cleaning brush in a printing apparatus to a first voltage bias. The method can include generating an image on media using a photoreceptor. The method can include cleaning the photoreceptor using the electrostatic cleaning brush operating at the first voltage bias. The method can include measuring operating conditions of the printing apparatus to determine an expected film accumulation rate on the photoreceptor. The method can include adjusting the voltage bias on the electrostatic cleaning brush to a second voltage bias based on the measured operating conditions.

The embodiments further include a printing apparatus that cleans a photoreceptor. The apparatus can include a photoreceptor configured to generate an image on media. The apparatus can include an electrostatic cleaning brush configured to clean the photoreceptor. The apparatus can include a voltage source configured to set a voltage bias of the electrostatic cleaning brush to a first voltage bias so the electrostatic cleaning brush operating at the first voltage bias cleans the photoreceptor. The apparatus can include an electrostatic cleaning brush bias controller configured to measure operating conditions of the printing apparatus to determine an expected film accumulation rate on the photoreceptor and configured to adjust the voltage bias on the electrostatic cleaning brush to a second voltage bias based on the measured operating conditions.

The embodiments further include method in a printing apparatus including a photoreceptor configured to generate an image on media and an electrostatic cleaning brush configured to clean the photoreceptor. The method can include setting a voltage bias of the electrostatic cleaning brush to a first voltage bias. The method can include generating an image on media using the photoreceptor. The method can include cleaning the photoreceptor using the electrostatic cleaning brush operating at the first voltage bias. The method can include measuring operating conditions of the printing apparatus to determine an expected film accumulation rate on the photoreceptor. The method can include adjusting the voltage bias on the electrostatic cleaning brush to a second voltage bias that is a function of the expected film accumulation rate to adjust a wear rate on the photoreceptor from the electrostatic cleaning brush.

Figure 1:
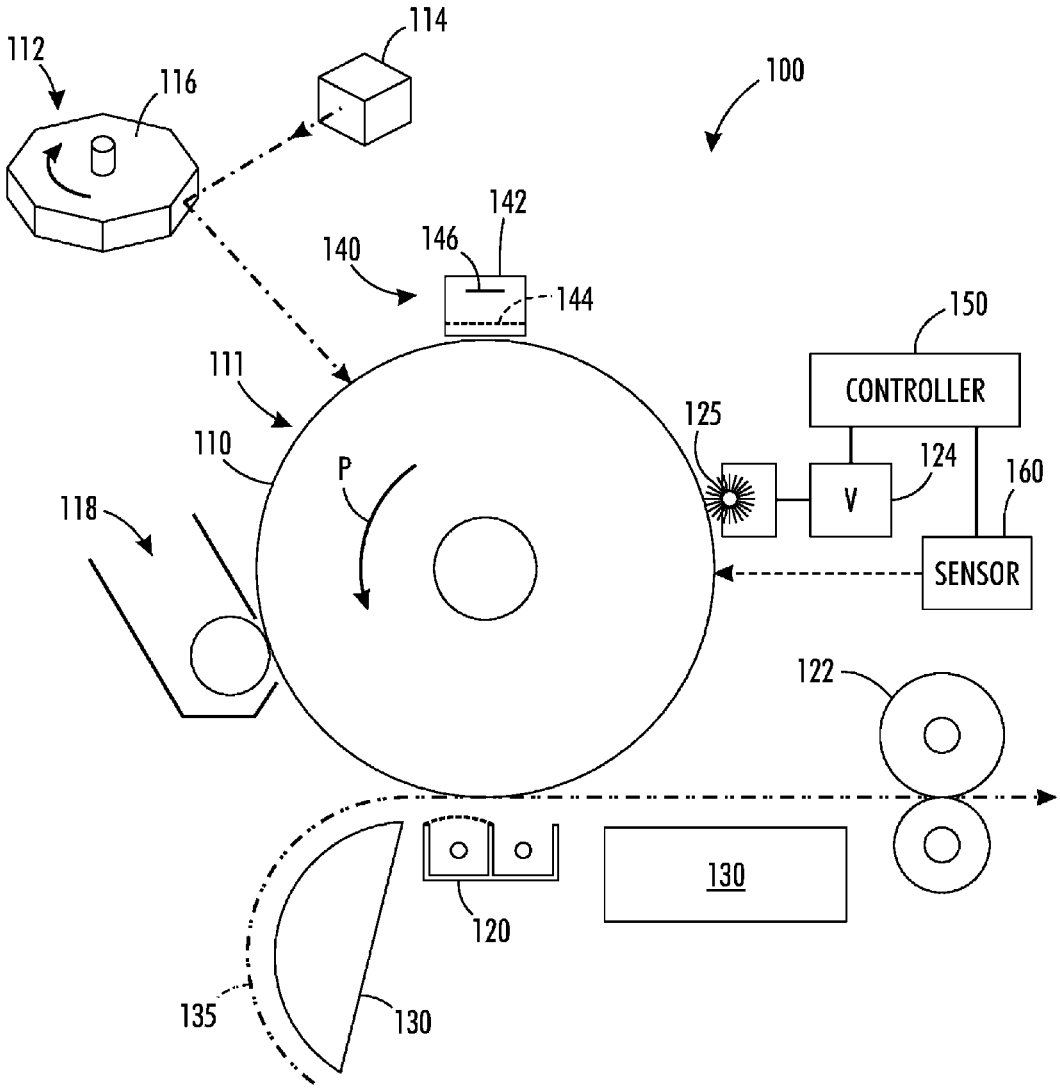
FIG. 1 is an exemplary diagram of an apparatus.

FIG. 1 is an exemplary illustration of an apparatus 100, such as an electrostatographic printing apparatus, a xerographic printing apparatus, or any other apparatus that generates an image on media. The apparatus 100 may also be part of a printer, a multifunction media device, a xerographic machine, a laser printer, or any other device that generates an image on media. The apparatus 100 can include a media transport 130 that can transport media 135, such as paper, plastic, stickers, or other media. The apparatus 100 can include a photoreceptor 110 movable in a process direction P. The photoreceptor 110 can have a main or charge transport surface 111. The photoreceptor 110 can be configured to generate an image on the media 135. For example, the photoreceptor 110 can be a belt or drum and can include a photoreceptor charge transport surface 111 for forming electrostatic images thereon.

The apparatus 100 can include a charger 140 configured to generate a charge on the photoreceptor 110. The charger 140 can be a scorotron, a charge roll, or any other electric field generation device, that can apply a voltage to a photoreceptor 110. For example, a scorotron 140 can include a scorotron shield 142, a scorotron charging grid 144, and a scorotron wire or pin array 146 located on an opposite side of the scorotron charging grid 144 from the photoreceptor 110. The scorotron pin array 146 can be configured to generate an electric field. The scorotron charging grid 144 and the scorotron pin array 146 can be configured to generate a surface potential on the photoreceptor 110. In a more detailed operation, the charger 140 can charge the photoreceptor 110 surface by imparting an electrostatic charge on the surface of the photoreceptor 110 as the photoreceptor 110 rotates in the process direction P.

The apparatus 100 can include an image generation module 112 configured to generate an image on the photoreceptor 110. The image generation module 112 can be a raster output scanner, such as a laser source, a Light Emitting Diode (LED) bar, or other relevant device, that can discharge selected portions of the photoreceptor 110 in a configuration corresponding to a desired image to be printed. For example, a raster output scanner can discharge a latent image to a more positive voltage. As a further example, the charger 112 can be a raster output scanner that can include a laser source 114 and a rotatable mirror 116, which can act together to discharge certain areas of the surface of the photoreceptor 110 according to a desired image to be printed. Other elements can be used instead of a laser source 114 to selectively discharge the charge-retentive surface 111, such as an LED bar, a light-lens system, or other elements that can discharge a charge-retentive surface. The laser source 114 can be modulated in accordance with digital image data fed into it, and the rotatable mirror 116 can cause the modulated beam from the laser source 114 to move in a fast-scan direction perpendicular to the process direction P of the photoreceptor 110.

The apparatus 100 can include a development unit 118 coupled to the photoreceptor 110. The development unit 118 can be configured to develop the image on the photoreceptor 110. For example, after certain areas of the photoreceptor 110 are discharged by the laser source 114, a developer unit 118 can develop an exposed latent image by applying a voltage bias using the developer unit 118. The developer unit 118 can cause a supply of marking material, such as dry toner, to contact or otherwise approach the exposed latent image on the surface of the photoreceptor 110.

The apparatus 100 can include a transfer unit 120 coupled to the photoreceptor 110. The transfer unit 120 can be configured to transfer the developed image to the media 135. For example, the transfer unit 120 can cause the toner, or other marking material, adhering to the photoreceptor 110 to be electrically transferred to the media 135. The apparatus 100 can include a fuser 122 that can permanently affix the image to the media 135. For example, the fuser 122 can cause marking material, such as toner, to melt or fuse into the media 135 to create a permanent image on the media 135.

The apparatus 100 can include an electrostatic cleaning brush 125 coupled to the main surface 111 of the charge receptor, such as a photoreceptor 110. The electrostatic cleaning brush 125 can be configured to clean the photoreceptor 110. The apparatus 100 can include a voltage source 124 configured to set a voltage bias of the electrostatic cleaning brush 125 to a first voltage bias so the electrostatic cleaning brush 125 operating at the first voltage bias cleans the photoreceptor 110. For example, film, such as particles, deposited chemicals, and other film, can build up on the photoreceptor 110 and the electrostatic cleaning brush 125 operating at the first voltage bias can clean film off the photoreceptor 110.

The apparatus 100 can include an electrostatic cleaning brush bias controller 150 configured to measure operating conditions of the apparatus 100 to determine an expected film accumulation rate on the photoreceptor 110. The operating conditions can include a relative humidity, a temperature, document area coverage, photoreceptor age, a type of image being printed, an amount of marking material, such as toner, on the photoreceptor 110, and/or a jam recovery mode operation condition. The electrostatic cleaning brush bias controller 150 can be configured to adjust the voltage bias on the electrostatic cleaning brush 125 to a second voltage bias based on the measured operating conditions.

For example, the electrostatic cleaning brush bias controller 150 can be configured to compare the expected film accumulation rate on the photoreceptor 110 to a threshold and can be configured to adjust the voltage bias by increasing the voltage bias on the electrostatic cleaning brush 125 to the second voltage bias if the expected film accumulation rate on the photoreceptor 110 exceeds the threshold. The second bias can be a function of the expected film accumulation rate.

As a further example, the image generation module 112 can be configured to generate image test patterns on the photoreceptor 110 during a film evaluation mode of the apparatus 100. The apparatus 100 can enter the film evaluation mode after a given period of time and/or after a given number of prints have been generated by the apparatus 100. For example, the film evaluation mode can be performed during a diagnostic mode, can be performed on test patterns in an interdocument zone, can be performed during a process control cycle, or can be performed at any other useful time for a film evaluation mode. The apparatus 100 can include an image sensor 160 configured to sense undesirable artifacts on the image test patterns on the photoreceptor during the film evaluation mode. The image sensor 160 can be a full width array sensor, a scanning sensor, a fixed spot sensor, or any other sensor. Alternate configurations may position the sensor to view the image on an intermediate belt or on the print media. The electrostatic cleaning brush bias controller 150 can be configured to measure operating conditions based on the sensed undesirable artifacts and can be configured to adjust the voltage bias on the electrostatic cleaning brush 125 to a second voltage bias based on the sensed undesirable artifacts. The voltage bias can be adjusted to eliminate the film or to maintain the film at a certain acceptable or desired level.

The electrostatic cleaning brush bias controller 150 can be configured to measure the operating conditions by determining whether the apparatus 100 is operating in a jam recovery mode to determine an expected film accumulation rate on the photoreceptor 100. The electrostatic cleaning brush bias controller 150 can be configured to adjust the voltage bias by setting the voltage bias to the first voltage bias if the apparatus 100 is not operating in the jam recovery mode and by setting the voltage bias to the second voltage bias if the apparatus 100 is operating in the jam recovery mode. Various bias levels can be used based on expected image content on the media.

The electrostatic cleaning brush bias controller 150 can be configured to adjust the voltage bias on the electrostatic cleaning brush 125 to a second voltage bias based on the measured operating conditions to adjust a wear rate on the photoreceptor 110 from the electrostatic cleaning brush 125. The electrostatic cleaning brush 125 can be a plurality of electrostatic cleaning brushes configured to clean the photoreceptor 110, where at least one electrostatic cleaning brush can operate at the first voltage bias. For example, there can be more than one brush in an electrostatic brush cleaning system. Different brushes can have different biases and different polarities. According to one embodiment, the voltage bias on a positively biased brush can be adjusted. For example, when two or more brushes are used, one can be positively biased and other can be negatively biased, but the positively biased brush can do more cleaning and can cause more photoreceptor wear. The bias of at least one negative brush can be switched to positive to increase photoreceptor wear. This can be useful if the bias of a single positive brush would be adjusted too high to achieve the desired photoreceptor wear or cleaning, because too high of a bias may cause arcing between the brush and the photoreceptor. The electrostatic cleaning brush bias controller 150 can be configured to adjust the voltage bias of at least one of the plurality of electrostatic cleaning brushes to a second voltage bias of a different polarity from the first voltage bias based on the measured operating conditions. The level of the voltage bias of the at least one of the plurality of electrostatic cleaning brushes can also be adjusted when adjusting the bias to a second voltage bias of a different polarity. For example, the photoreceptor can have negative charged toner cleaned with positive charged brushes, but can also have the opposite polarities of charges. However, the positive charged brush can be more efficient at cleaning film on the photoreceptor. If one cleaning brush is used, the polarity on the brush can be reversed accordingly using a dedicated film reduction mode.

The electrostatic cleaning brush 125 can contribute to the wear of the photoreceptor surface 111. By adjusting the bias on the electrostatic cleaning brush 125, the resulting photoreceptor 110 wear rate can be adjusted. The electrostatic cleaning brush 125 bias can be used as an actuator to mitigate film accumulation as needed. In this method, the electrostatic cleaning brush 125 bias can be kept as low as possible while being consistent with good cleaning to minimize wear, but the electrostatic cleaning brush 125 bias can be increased as required to prevent excessive photoreceptor filming. In addition, the electrostatic cleaning brush 125 bias can be reduced from the nominal value currently in use to the level required to clean the actual film on the photoreceptor 110. Using this approach, both the photoreceptor 110 wear rate and the robustness to filming can be jointly optimized.

An experiment conducted in a print engine has demonstrated that the bias applied to the brushes in an electrostatic brush cleaner has a significant impact on the rate of photoreceptor wear. The print engine in the experiment included a dual electrostatic cleaning brush system with biases of opposite polarity applied to each of the brushes. In the wear experiment, each applied brush bias was tested at two different levels and the outputs were measurements of the photoreceptor surface that are indicative of wear. The bias applied to the brushes in an electrostatic brush cleaner had a significant impact on the rate of photoreceptor wear. Also, the applied positive bias was quite a large contributor to the measured wear outputs.

Embodiments provide for the use of electrostatic cleaning brush bias to control photoreceptor wear and filming. Embodiments also provide for the use of electrostatic cleaning brush bias as an actuator in a system to control photoreceptor wear rate and filming. While lower brush biases can be used for cleaning lower marking material inputs, embodiments also provide for changing the cleaner bias to impact photoreceptor wear from the adjusted bias. According to some embodiments, by controlling photoreceptor abrasion to only the level required for removal of films, the life of the photoreceptor can be increased. Increased photoreceptor life can decrease run cost and provide increased photoreceptor and printing apparatus up time.

Control of photoreceptor wear rate and filming can provide longer photoreceptor life and more robust maintenance of print quality and the photoreceptor is not excessively worn when conditions do not require high wear. Also, changing the brush bias can be easier than other cleaning adjustment methods. By adjusting the electrostatic brush electrostatic cleaning brush bias to control filming levels, the abrasion actuator, i.e., the brush bias, can be adjusted to suit the existing filming conditions. Embodiments can apply to devices using electrostatic brush cleaners, such as small desktop printing devices, industrial printing devices, and other devices that use electrostatic brush cleaners.

Figure 2:
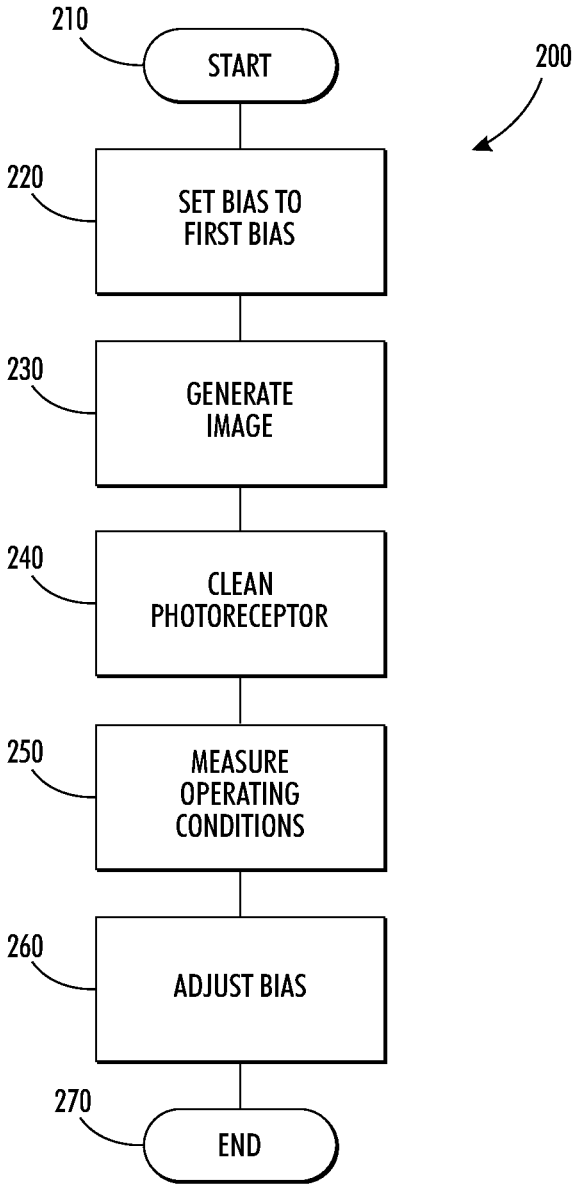
FIG. 2 illustrates an exemplary flowchart of a method of cleaning a photoreceptor in a printing apparatus.

FIG. 2 illustrates an exemplary flowchart 200 of a method of cleaning a photoreceptor in a printing apparatus, such as the apparatus 100. The printing apparatus can include a photoreceptor configured to generate an image on media and an electrostatic cleaning brush configured to clean the photoreceptor. The method starts at 210. At 220, a voltage bias of the electrostatic cleaning brush can be set to a first voltage bias. At 230, an image can be generated on media using the photoreceptor. The image can be generated using toner or other marking material. At 240, the photoreceptor can be cleaned using the electrostatic cleaning brush operating at the first voltage bias. The photoreceptor can also be cleaned using a plurality of electrostatic cleaning brushes, where at least one electrostatic cleaning brush operates at the first voltage bias.

At 250, operating conditions of the printing apparatus can be measured to determine an expected film accumulation rate on the photoreceptor. The operating conditions can include at least one of a relative humidity, a temperature, document area coverage, photoreceptor age, a type of image being printed, an amount of marking material, such as toner, on the photoreceptor, a jam recovery mode operation condition, and/or other print apparatus operating conditions. At 260, the voltage bias on the electrostatic cleaning brush can be adjusted to a second voltage bias based on the measured operating conditions. The second bias can be a function of the expected film accumulation rate. The voltage bias on the electrostatic cleaning brush can be adjusted to a second voltage bias based on the measured operating conditions to adjust a wear rate on the photoreceptor from the adjusted bias of the electrostatic cleaning brush. The voltage bias of at least one of a plurality of electrostatic cleaning brushes can be adjusted to a second voltage bias of a different polarity from the first voltage bias based on the measured operating conditions.

According to some embodiments, the flowchart 200 or blocks of the flowchart 200 may be performed numerous times, such as iteratively. For example, the flowchart 200 may loop back from later blocks to earlier blocks. Furthermore, many of the blocks can be performed concurrently or in parallel processes. At 270, the method can end.

Figure 3:
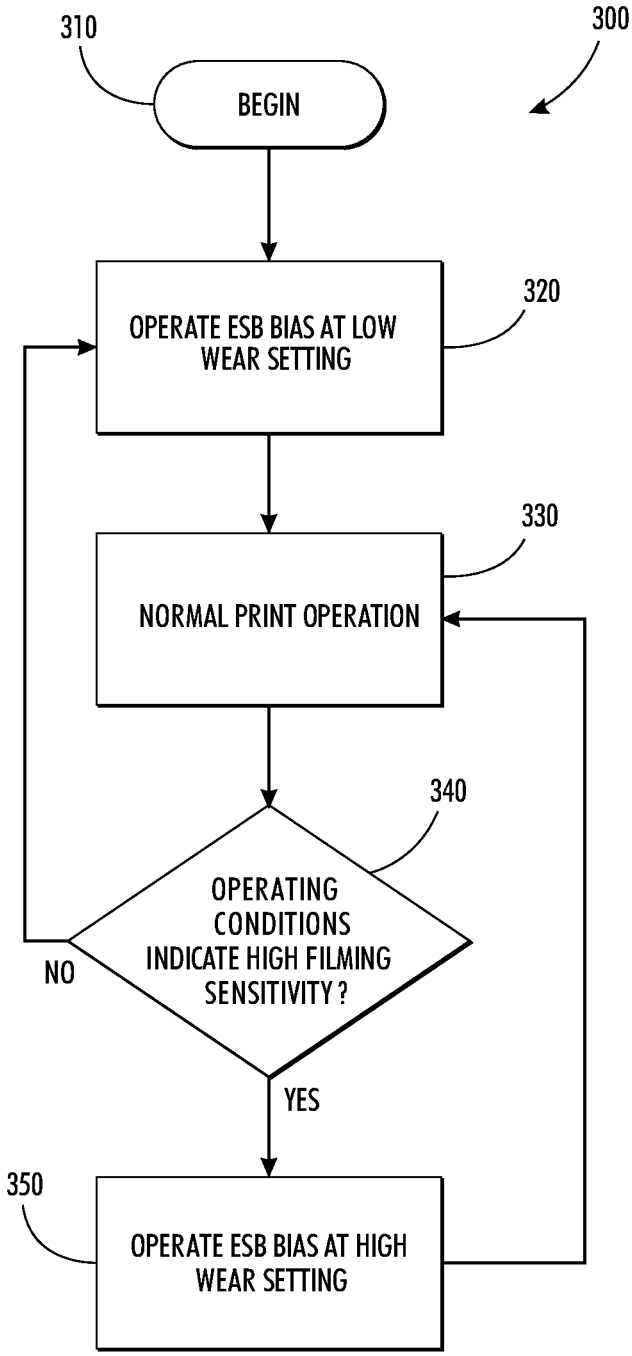
FIG. 3 illustrates an exemplary flowchart of a method of cleaning a photoreceptor in a printing apparatus.

FIG. 3 illustrates an exemplary flowchart 300 of a method of cleaning a photoreceptor in a printing apparatus, such as the apparatus 100. The method begins at 310. At 320, an electrostatic cleaning brush can operate at a low wear bias setting when cleaning a photoreceptor. The low wear setting can be a lower bias setting that generates low wear of the photoreceptor. At 330, the printing apparatus can operate normally for generating images on media sheets and for cleaning the photoreceptor using the current bias setting. At 340, it can be determined whether operating conditions indicate high filming sensitivity of the photoreceptor. If not, the method can return to block 320. If operating conditions indicate high filming sensitivity, at 350, the electrostatic cleaning brush can operate at a high wear setting for its bias to accommodate for the high filming. The electrostatic cleaning brush can continue to operate at the high wear setting until the operating conditions return to low filming at step 340. According to some embodiments, some or all of the blocks of the flowchart 300 can be used along with and/or can replace other related blocks of the other disclosed flowcharts. The flowchart 300 can measure current operating conditions to determine the expected film accumulation rate. The electrostatic cleaning brush cleaner bias can be maintained at a low wear setting unless the expected film accumulation rate exceeds a threshold value. Factors that can contribute to enhanced filming rates can include relative humidity, temperature, document area coverage, developer age, and other factors that contribute to enhanced filming rates. Based on measurements of these critical factors, the expected sensitivity of the photoreceptor to filming can be inferred.

Figure 4:
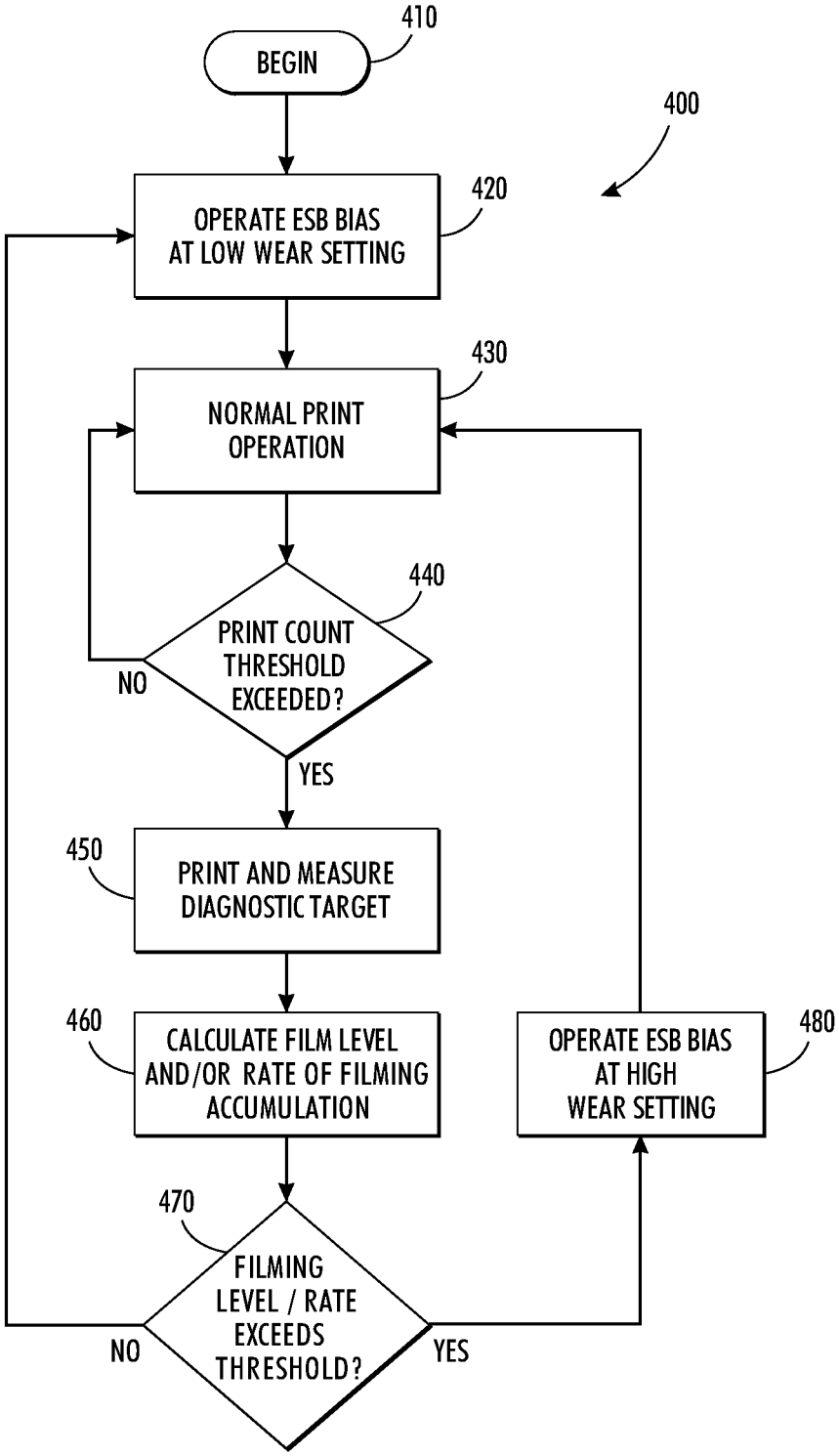
FIG. 4 illustrates an exemplary flowchart of a method of cleaning a photoreceptor in a printing apparatus.

FIG. 4 illustrates an exemplary flowchart 400 of a method of cleaning a photoreceptor in a printing apparatus, such as the apparatus 100. The method begins at 410. At 420, an electrostatic cleaning brush can operate at a low wear bias setting when cleaning a photoreceptor. At 430, the printing apparatus can operate normally for generating images on media sheets and for cleaning the photoreceptor using the current bias setting.

At 440, it can be determined whether a print count exceeds a threshold. For example, a film evaluation mode of the printing apparatus can be entered after a given period of time and/or after a given number of prints have been generated by the printing apparatus. If the print count does not exceed the threshold, the method can return to block 430. If the print count exceeds the threshold or a given period of time has passed, at 450, a diagnostic target image can be printed and measured from the photoreceptor. For example, image test patterns can be generated on the photoreceptor during the film evaluation mode of the printing apparatus. Operating conditions can be measured by sensing, using an image sensor, undesirable artifacts on the image test patterns on the photoreceptor during the film evaluation mode. At 460, a film level and/or a rate of filming on the photoreceptor can be calculated.

At 470, the expected film accumulation rate on the photoreceptor can be compared to a threshold. For example, whether operating conditions indicate high filming sensitivity of the photoreceptor can be determined. If the expected film accumulation rate on the photoreceptor does not exceed the threshold, the method can return to block 420. If the expected film accumulation rate on the photoreceptor exceeds the threshold, at 480, the electrostatic cleaning brush can operate at a high wear bias setting. For example, the voltage bias on the electrostatic cleaning brush can be increased to the second voltage bias if the expected film accumulation rate on the photoreceptor exceeds the threshold. As a further example, the voltage bias on the electrostatic cleaning brush can be adjusted to a second voltage bias based on the sensed undesirable artifacts. The electrostatic cleaning brush can operate at a high wear setting for its bias to accommodate for the high filming. The electrostatic cleaning brush can continue to operate at the high wear setting until the print count exceeds another threshold at 440 and/or until the filming level or rate falls below a threshold at step 470. According to some embodiments, the flowchart 400 or blocks of the flowchart 400 may be performed numerous times, such as iteratively. For example, the flowchart 400 may loop back from later blocks to earlier blocks. Furthermore, many of the blocks can be performed concurrently or in parallel processes. Also, some or all of the blocks of the flowchart 400 can be used along with and/or can replace other related blocks of the other disclosed flowcharts.

The flowchart 400 can make use of measurements of the actual filming level, or filming rate, of the photoreceptor surface. By printing special test patterns during a diagnostic mode, the filming state of the photoreceptor can be measured using an in-situ image sensor. Since filming eventually leads to image quality artifacts, the onset of such artifacts can be detected and used as a trigger for more aggressive cleaning of the photoreceptor surface. When feedback measurements of the film state of the photoreceptor warrant more aggressive cleaning, the applied bias to the electrostatic cleaning brush can be increased to a high wear setting. Thus, the wear rate of the photoreceptor surface can be maintained as low as possible while ensuring that excessive filming does not occur.

Figure 5:
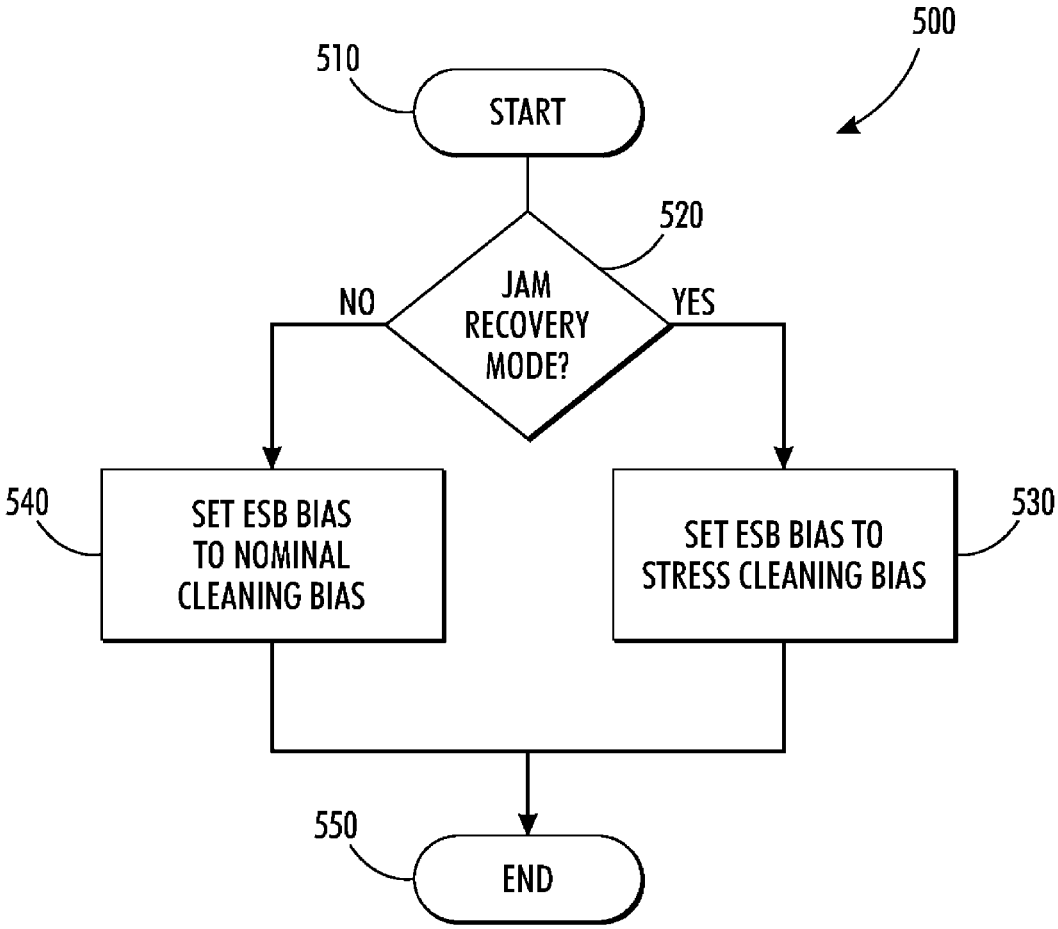
FIG. 5 illustrates an exemplary flowchart of a method of cleaning a photoreceptor in a printing apparatus.

FIG. 5 illustrates an exemplary flowchart 500 of a method of cleaning a photoreceptor in a printing apparatus, such as the apparatus 100. The method begins at 510. At 520, a determination can be made as to whether the printing apparatus is operating in a jam recovery mode to determine an expected film accumulation rate on a photoreceptor. If the printing apparatus is not operating in the jam recovery mode, at 540, the voltage bias on an electrostatic cleaning brush can be adjusted by setting the voltage bias to a first voltage bias. For example, the voltage bias on an electrostatic cleaning brush can be set to a nominal cleaning bias. If the printing apparatus is operating in the jam recovery mode, at 530, the voltage bias can be set to a second voltage bias. For example, the voltage bias on an electrostatic cleaning brush can be set to a stress cleaning bias. According to some embodiments, some or all of the blocks of the flowchart 500 can be used along with and/or can replace other related blocks of the other disclosed flowcharts. At 550, the method can end.

According to some embodiments, the electrostatic cleaning brush low wear bias setting can be the nominal electrostatic cleaning brush bias currently in use or an electrostatic cleaning brush bias chosen to correspond to the actual toner input to the cleaner. In its simplest form, the decision on what electrostatic cleaning brush bias to use can be made based on whether or not the machine is operating normally or is operating in jam recovery mode. The flowchart 500 shows an example of this decision process. Additionally, cleaning input can be determined through knowledge of the images being printed or through direct measurement of the toner on the photoreceptor after transfer with an appropriate detector. The cleaning brush bias can then be set to a level corresponding to the determined cleaner input. The differences between the biases required under normal operation can be smaller than the difference between normal operation and jam recovery.

Figure 6:
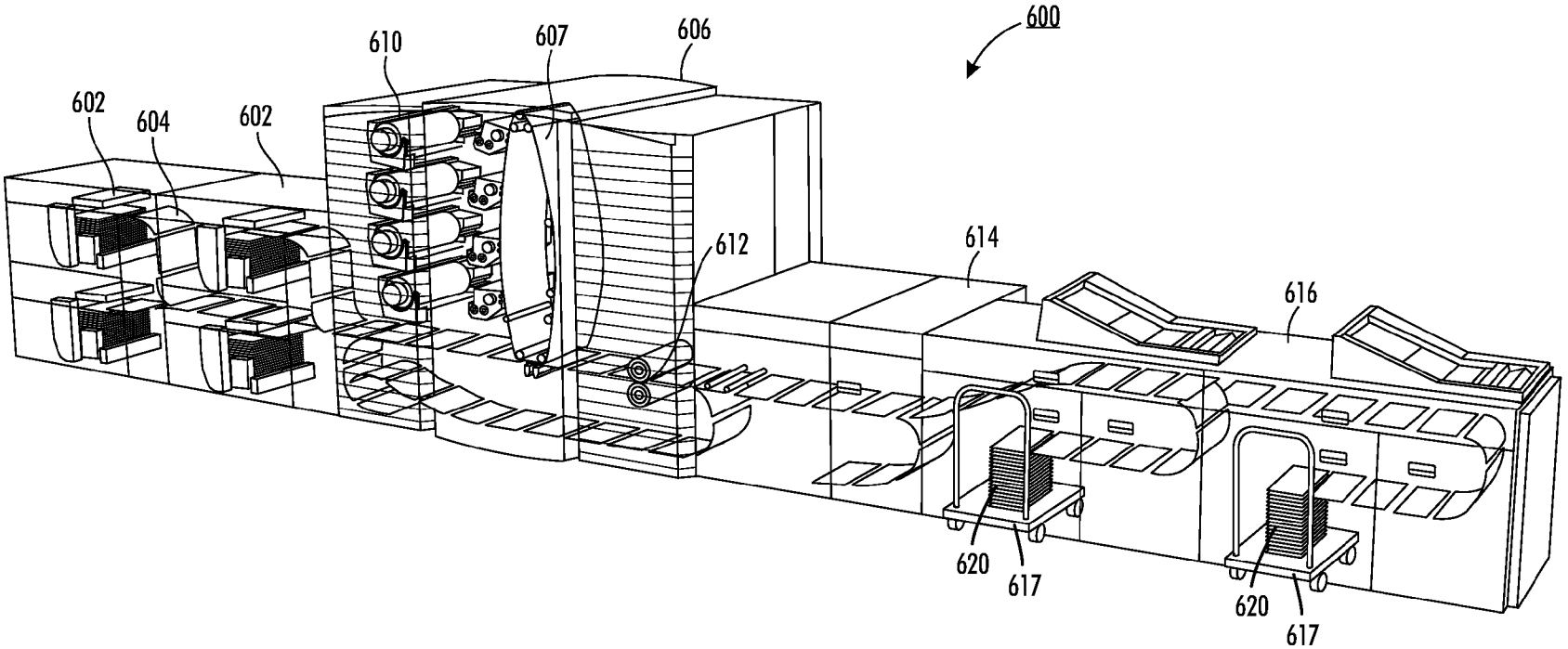
FIG. 6 illustrates an exemplary printing apparatus.

FIG. 6 illustrates an exemplary printing apparatus 600, such as the apparatus 100. As used herein, the term "printing apparatus" encompasses any apparatus, such as a digital copier, bookmaking machine, multifunction machine, and other printing devices that perform a print outputting function for any purpose. The printing apparatus 600 can be used to produce prints from various media, such as coated, uncoated, previously marked, or plain paper sheets. The media can have various sizes and weights. In some embodiments, the printing apparatus 600 can have a modular construction. As shown, the printing apparatus 600 can include at least one media feeder module 602, a printer module 606 adjacent the media feeder module 602, an inverter module 614 adjacent the printer module 606, and at least one stacker module 616 adjacent the inverter module 614.

In the printing apparatus 600, the media feeder module 602 can be adapted to feed media 604 having various sizes, widths, lengths, and weights to the printer module 606. In the printer module 606, toner or other marking material is transferred from an arrangement of developer stations 610 to a charged photoreceptor belt 607 to form toner images on the photoreceptor belt 607. Embodiments can work in black and white printer modules with one development unit around a drum photoreceptor, in color printer modules with multiple developer units around a belt photoreceptor, and in other printer modules with other configurations of development units and photoreceptors. The toner images are transferred to the media 604 fed through a paper path. The media 604 are advanced through a fuser 612 adapted to fuse the toner images on the media 604. The inverter module 614 manipulates the media 604 exiting the printer module 606 by either passing the media 604 through to the stacker module 616, or by inverting and returning the media 604 to the printer module 606. In the stacker module 616, printed media are loaded onto stacker carts 617 to form stacks 620.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in a printing apparatus including a photoreceptor configured to generate an image on media and an electrostatic cleaning brush configured to clean the photoreceptor, the method comprising:

setting a voltage bias of the electrostatic cleaning brush to a first voltage bias;

generating an image on media using the photoreceptor;

cleaning the photoreceptor using the electrostatic cleaning brush operating at the first voltage bias;

measuring operating conditions of the printing apparatus to determine an expected film accumulation rate on the photoreceptor; and adjusting the voltage bias on the electrostatic cleaning brush to a second voltage bias based on the measured operating conditions, wherein measuring operating conditions comprises determining whether the printing apparatus is operating in a jam recovery mode to determine an expected amount of toner on the photoreceptor.

2. The method according to claim 1, further comprising comparing the expected film accumulation rate on the photoreceptor to a threshold, wherein adjusting comprises increasing the voltage bias on the electrostatic cleaning brush to the second voltage bias if the expected film accumulation rate on the photoreceptor exceeds the threshold.

3. The method according to claim, 1, wherein the second bias is a function of the expected film accumulation rate.

4. The method according to claim 1, further comprising generating image test patterns on the photoreceptor during a film evaluation mode of the printing apparatus, wherein measuring the operating conditions comprises sensing, using an image sensor, undesirable artifacts on the image test patterns on the photoreceptor during the film evaluation mode, and wherein adjusting the voltage bias on the electrostatic cleaning brush comprises adjusting the voltage bias on the electrostatic cleaning brush to a second voltage bias based on the sensed undesirable artifacts.

5. The method according to claim 4, further comprising entering the film evaluation mode of the printing apparatus after at least one of a given period of time and a given number of prints generated by the printing apparatus.

6. The method according to claim 1, wherein the operating conditions comprise at least one of a relative humidity, a temperature, document area coverage, photoreceptor age, a type of image being printed, an amount of toner on the photoreceptor, an amount of marking material on the photoreceptor, and a jam recovery mode operation condition.

7. The method according to claim 1, wherein adjusting the voltage bias on the electrostatic cleaning brush comprises setting the voltage bias to the first voltage bias if the printing apparatus is not operating in the jam recovery mode and setting the voltage bias to the second voltage bias if the printing apparatus is operating in the jam recovery mode.

8. The method according to claim 1, wherein adjusting the voltage bias comprises adjusting the voltage bias on the electrostatic cleaning brush to a second voltage bias based on the measured operating conditions to adjust a wear rate on the photoreceptor from the adjusted bias of the electrostatic cleaning brush.

9. The method according to claim 1, wherein cleaning comprises cleaning the photoreceptor using a plurality of electrostatic cleaning brushes, where at least one electrostatic cleaning brush operates at the first voltage bias.

10. The method according to claim 9, wherein adjusting comprises adjusting the voltage bias of at least one of the plurality of electrostatic cleaning brushes to a second voltage bias of a different polarity from the first voltage bias based on the measured operating conditions.

11. A printing apparatus comprising:

a photoreceptor configured to generate an image on media;

an electrostatic cleaning brush configured to clean the photoreceptor;

a voltage source configured to set a voltage bias of the electrostatic cleaning brush to a first voltage bias so the electrostatic cleaning brush operating at the first voltage bias cleans the photoreceptor;

an electrostatic cleaning brush bias controller configured to measure operating conditions of the printing apparatus to determine an expected film accumulation rate on the photoreceptor and configured to adjust the voltage bias on the electrostatic cleaning brush to a second voltage bias based on the measured operating conditions, wherein measuring operating conditions comprises determining whether the printing apparatus is operating in a jam recovery mode to determine an expected amount of toner on the photoreceptor.

12. The printing apparatus according to claim 11, wherein the electrostatic cleaning brush bias controller is configured to compare the expected film accumulation rate on the photoreceptor to a threshold and configured to adjust the voltage bias by increasing the voltage bias on the electrostatic cleaning brush to the second voltage bias if the expected film accumulation rate on the photoreceptor exceeds the threshold.

13. The printing apparatus according to claim, 11, wherein the second bias is a function of the expected film accumulation rate.

14. The printing apparatus according to claim 11, further comprising:

an image generation module configured to generate image test patterns on the photoreceptor during a film evaluation mode of the printing apparatus; and an image sensor configured to sense undesirable artifacts on the image test patterns on the photoreceptor during the film evaluation mode, wherein the electrostatic cleaning brush bias controller is configured to measure operating conditions based on the sensed undesirable artifacts and configured to adjust the voltage bias by adjusting the voltage bias on the electrostatic cleaning brush to a second voltage bias based on the sensed undesirable artifacts.

15. The printing apparatus according to claim 11, wherein the electrostatic cleaning brush bias controller is configured to adjust the voltage bias by setting the voltage bias to the first voltage bias if the printing apparatus is not operating in the jam recovery mode and by setting the voltage bias to the second voltage bias if the printing apparatus is operating in the jam recovery mode.

16. The printing apparatus according to claim 11, wherein the electrostatic cleaning brush bias controller is configured to adjust the voltage bias by adjusting the voltage bias on the electrostatic cleaning brush to a second voltage bias based on the measured operating conditions to adjust a wear rate on the photoreceptor from the electrostatic cleaning brush.

17. The printing apparatus according to claim 11, wherein the electrostatic cleaning brush comprises a plurality of electrostatic cleaning brushes configured to clean the photoreceptor, where at least one electrostatic cleaning brush operates at the first voltage bias.

18. The printing apparatus according to claim 17, wherein the electrostatic cleaning brush bias controller is configured to adjust the voltage bias of at least one of the plurality of electrostatic cleaning brushes to a second voltage bias of a different polarity from the first voltage bias based on the measured operating conditions.

19. A method in a printing apparatus including a photoreceptor configured to generate an image on media and an electrostatic cleaning brush configured to clean the photoreceptor, the method comprising:

setting a voltage bias of the electrostatic cleaning brush to a first voltage bias;

generating an image on media using the photoreceptor;

cleaning the photoreceptor using the electrostatic cleaning brush operating at the first voltage bias;

measuring operating conditions of the printing apparatus to determine an expected film accumulation rate on the photoreceptor; and adjusting the voltage bias on the electrostatic cleaning brush to a second voltage bias that is a function of the expected film accumulation rate to adjust a wear rate on the photoreceptor from the electrostatic cleaning brush, wherein measuring operating conditions comprises determining whether the printing apparatus is operating in a jam recovery mode to determine an expected amount of toner on the photoreceptor.

20. The method according to claim 19, further comprising comparing the expected film accumulation rate on the photoreceptor to a threshold, wherein adjusting comprises increasing the voltage bias on the electrostatic cleaning brush to the second voltage bias to increase wear on the photoreceptor from the increased voltage bias on the electrostatic cleaning brush if the expected film accumulation rate on the photoreceptor exceeds the threshold.

* * * * *